US012644628B2

(12) United States Patent
Welch et al.

(10) Patent No.: US 12,644,628 B2
(45) Date of Patent: Jun. 2, 2026

(54) CLIMATE CONTROL SYSTEMS HAVING A LIQUID-TO-SUCTION HEAT EXCHANGER, AN ACCUMULATOR, AND A RECEIVER FOR VARIABLE LIQUID STORAGE OF HIGH GLIDE WORKING FLUIDS AND METHODS FOR OPERATION THEREOF

(71) Applicant: COPELAND LP, Sidney, OH (US)

(72) Inventors: Andrew M. Welch, Franklin, OH (US); Kory M. Place, Sidney, OH (US)

(73) Assignee: Copeland LP, Sidney, OH (US)

( * ) Notice: Subject to any disclaimer, the term of this patent is extended or adjusted under 35 U.S.C. 154(b) by 252 days.

(21) Appl. No.: 18/507,523

(22) Filed: Nov. 13, 2023

(65) Prior Publication Data

US 2025/0155166 A1 May 15, 2025

(51) Int. Cl.
*F25B 9/00* (2006.01)
*F25B 40/00* (2006.01)
(Continued)

(52) U.S. Cl.
CPC ..... *F25B 9/006* (2013.01); *F25B 40/00* (2013.01); *F25B 41/20* (2021.01); *F25B 41/42* (2021.01); *F25B 2400/121* (2013.01)

(58) Field of Classification Search
CPC ..... F25B 9/008; F25B 49/02; F25B 43/006; F25B 41/39; F25B 2400/16; F25B 2400/054
See application file for complete search history.

(56) References Cited

U.S. PATENT DOCUMENTS 4,249,389 A 2/1981 Mayer
4,303,090 A 12/1981 Mayer
(Continued)

FOREIGN PATENT DOCUMENTS

AU 2017238687 B2 7/2019
CN 108463676 A 8/2018
(Continued)

OTHER PUBLICATIONS

European Search Report issued Apr. 11, 2025, for EP Application No. 24212669.6; 7 pages.
(Continued)

*Primary Examiner* — Ana M Vazquez
(74) *Attorney, Agent, or Firm* — Harness, Dickey & Pierce, P.L.C.

(57) ABSTRACT

Climate control systems that circulates a refrigerant blend having high glide (difference in boiling points of refrigerants≥25°R (about 14K) at atmospheric pressure) include an accumulator, a compressor, a first heat exchanger for at least partially condensing the refrigerant blend, a liquid-to-suction heat exchanger disposed downstream of the first heat exchanger and upstream of the accumulator, a first expansion device, a receiver, a second expansion device, and a second heat exchanger that at least partially vaporizes the refrigerant blend, and a fluid conduit. A concentration of the refrigerant blend can be controlled by adjusting stored liquid levels in the accumulator and receiver. Methods for operating a climate control system that circulates a working fluid comprising a refrigerant blend having high glide are also provided.

20 Claims, 3 Drawing Sheets

(51) Int. Cl.
*F25B 41/20* (2021.01)
*F25B 41/42* (2021.01)

(56) References Cited

U.S. PATENT DOCUMENTS

| | | | | |
|---|---|---|---|---|
| 4,702,086 | A | 10/1987 | Nunn, Sr. et al. | |
| 4,787,211 | A | 11/1988 | Shaw | |
| 4,788,352 | A | 11/1988 | Smutny | |
| 5,174,123 | A | 12/1992 | Erickson | |
| 6,058,727 | A | 5/2000 | Fraser, Jr. et al. | |
| 6,070,420 | A | 6/2000 | Biancardi et al. | |
| 6,662,576 | B1 | 12/2003 | Bai | |
| 6,901,763 | B2 * | 6/2005 | Memory | F25B 43/006 62/503 |
| 7,131,294 | B2 | 11/2006 | Manole | |
| 7,261,151 | B2 | 8/2007 | Memory et al. | |
| 7,600,390 | B2 | 10/2009 | Manole | |
| 8,444,874 | B2 | 5/2013 | Singh et al. | |
| 8,522,564 | B2 | 9/2013 | Koppineedi et al. | |
| 8,887,524 | B2 * | 11/2014 | Mihara | F25B 9/008 62/498 |
| 8,955,343 | B2 | 2/2015 | Verma et al. | |
| 9,212,834 | B2 | 12/2015 | Parsonnet et al. | |
| 9,541,311 | B2 | 1/2017 | Hinde et al. | |
| 9,689,590 | B2 | 6/2017 | Christensen | |
| 10,400,149 | B2 | 9/2019 | Schultz et al. | |
| 10,473,369 | B2 | 11/2019 | Talhouarn | |
| 10,655,040 | B2 | 5/2020 | Close et al. | |
| 10,697,683 | B2 | 6/2020 | Sun et al. | |
| 10,907,863 | B2 | 2/2021 | Sethi et al. | |
| 11,131,471 | B1 | 9/2021 | Butler et al. | |
| 11,466,907 | B2 | 10/2022 | Bandhauer et al. | |
| 2021/0063063 | A1 | 3/2021 | Gentry | |
| 2021/0123637 | A1 | 4/2021 | Petersen et al. | |
| 2021/0396436 | A1 | 12/2021 | Hartfield et al. | |
| 2022/0082304 | A1 | 3/2022 | Welch et al. | |
| 2022/0252311 | A1 | 8/2022 | Lord | |
| 2022/0404105 | A1 | 12/2022 | Vaisman et al. | |
| 2023/0130167 | A1 | 4/2023 | Welch et al. | |

FOREIGN PATENT DOCUMENTS

| | | | | |
|---|---|---|---|---|
| GB | 2508614 | A | 6/2014 | |
| JP | 2015140980 | A | 8/2015 | |
| WO | WO-2009110228 | A1 * | 9/2009 | F25B 9/006 |
| WO | WO-2011070917 | A1 * | 6/2011 | F25B 45/00 |
| WO | WO-2022259287 | A1 * | 12/2022 | F25B 43/00 |

OTHER PUBLICATIONS

Larrondo-Sancho, R. et al.; "Experimental Evaluation of the Novel R744/R1270 Blend in a Transcrital Refrigeration Plant"; ICR2023, 26th International Congress of Refrigeration; Aug. 21-25, 2023; 10 pages.

Sicco, Emanuele et al.; "Experimental Evaluation of Different Refrigeration System Configurations Using CO2-Based Blends as Refrigerants"; ICR2023, International Congress of Refrigeration; Aug. 21-25, 2023; 11 pages.

2010 ASHRAE Handbook; HVAC Systems and Equipment; Chapter 37 Solar Energy Equipment and Systems; https://handbook.ashrae.org/Print.html?file=https://handbook.ashrae.org/Handbooks/S20/IP/S20_Ch37/S20_ch37_ip.aspx; downloaded Dec. 1, 2021; 44 pages.

* cited by examiner

CLIMATE CONTROL SYSTEMS HAVING A LIQUID-TO-SUCTION HEAT EXCHANGER, AN ACCUMULATOR, AND A RECEIVER FOR VARIABLE LIQUID STORAGE OF HIGH GLIDE WORKING FLUIDS AND METHODS FOR OPERATION THEREOF

FIELD

The present disclosure relates to climate control systems for use with working fluids having refrigerant blends exhibiting high glide and methods for operating the same and more specifically to climate control systems having a liquid-to-suction heat exchanger, accumulator, and receiver for controlling refrigerant concentrations.

BACKGROUND

This section provides background information related to the present disclosure which is not necessarily prior art.

A conventional thermodynamic climate control system such as, for example, a heat-pump system, a refrigeration system, or an air conditioning system, may include a fluid circuit having a first heat exchanger (e.g., a condenser that facilitates a phase change of refrigerant from gas/vapor phase to a liquid) that is typically located outdoors, a second heat exchanger (e.g., evaporator that facilitates a phase change of refrigerant from liquid to gas/vapor phase) that is typically located indoors or within the environment to be cooled, an expansion device disposed between the first and second heat exchangers, and a compressor that operates via a vapor compression cycle (VCC) to circulate and pressurize a gas/vapor phase refrigerant (and optional lubricant oil) between the first and second heat exchangers (e.g., condenser and evaporator). The compressor is typically a mechanical compressor that serves to pressurize the refrigerant, which can be subsequently condensed and evaporated as it is circulated within the system to transfer heat into or out of the system.

Refrigeration and air conditioning applications are under increased regulatory pressure to reduce the global warming potential of the refrigerants they use. Some of the challenges of current climate control working medium include meeting device applicability, environmental acceptability, and safety. For this reason, synthetic refrigerants are anticipated to be replaced by natural refrigerants in some vapor compression applications. Further, in order to use lower global warming potential refrigerants, the flammability of the refrigerants may increase.

Several refrigerants have been developed that are considered low global warming potential options, and they have an ASHRAE (American Society of Heating, Refrigerating and Air-Conditioning Engineers) classification as A2 (relatively lower flammability than A3 refrigerants), A2L (mildly flammable/lower flammability than A2 and A3 refrigerants and lower toxicity), or A1 (no flame propagation/lower toxicity levels). Examples of an A2 refrigerant include 1,1-difluoroethane (R-152A—as used herein, the refrigerants may be interchangeably described by the conventional nomenclature of "R" for refrigerant or their specific chemical class code, like HFC-152A) with a global warming potential of about 124, while examples of A2L refrigerants include difluoromethane ($CH_2F_2$ or R-32—as used herein, the refrigerants may be interchangeably described by the conventional nomenclature of "R" for refrigerant or their specific chemical class code, like HFC-32) with a global warming potential of about 677, and hydrofluorolefins (HFOs), like 2,3,3,3,-tetrafluoroprop-1-ene (HFO-1234yf or R-1234yf), trans-1,3,3,3,-tetrafluoroprop-1-ene (HFO-1234ze or R-1234ze). A1 refrigerants include carbon dioxide ($CO_2$ or R-744), which has a desirably low global warming potential of 1, 1-chloro-3,3,3-trifluoropropene (cis- and trans-HFO-1233zd(Z) or R-1233zd(Z) and HFO-1233zd(E) or R-1233zd(E)), chlorodifluoromethane (R-22 or $CHClF_2$), and R-410A that is a near-azeotropic mixture of difluoromethane (HFC-32) and pentafluoroethane (HFC-125).

In particular, the heating, ventilation, air conditioning, and refrigeration (HVAC/R) industry has been searching for A1 (non-toxic and non-flammable) refrigerants, including blends with such A1 refrigerants, that have high cooling capacity per displacement, while desirably avoiding supercritical operation and sub-atmospheric pressures in order to enable low-cost compression and piping, while protecting the safety of the equipment operators and users. Thus, it would be desirable to employ climate control systems that can successfully employ such environmentally friendly refrigerants with low Global Warming Potential.

SUMMARY

This section provides a general summary of the disclosure, and is not a comprehensive disclosure of its full scope or all of its features.

In certain aspects, the present disclosure relates to a climate control system that circulates a working fluid comprising a refrigerant blend having high glide. The climate control system may comprise the working fluid comprising a first refrigerant and a second refrigerant. In various aspects, a difference in boiling points between the first refrigerant and the second refrigerant is greater than or equal to about 25°R (about 14K) at atmospheric pressure. The climate control system also comprises an accumulator and a compressor that receives a vapor stream of the working fluid from the accumulator and generates a pressurized vapor stream. The climate control system also comprises a first heat exchanger disposed downstream of the compressor that receives and cools the pressurized vapor stream to generate a multiphase or liquid condensate stream of the working fluid. A liquid-to-suction heat exchanger is disposed downstream of the first heat exchanger and upstream of the accumulator. A receiver is disposed downstream of the liquid-to-suction heat exchanger. The climate control system also comprises a first expansion device disposed between the liquid-to-suction heat exchanger and the receiver that processes the multiphase or liquid condensate stream from the liquid-to-suction heat exchanger, as well as a second expansion device disposed between the receiver and a second heat exchanger that processes the multiphase or liquid condensate stream to reduce pressure prior to the second heat exchanger to form a reduced-pressure multiphase stream of the working fluid. The climate control system also includes the second heat exchanger that receives the reduced-pressure multiphase stream from the second expansion device and at least partially vaporizes the reduced-pressure multiphase stream to form a vaporized stream of the working fluid that is then directed to the liquid-to-suction heat exchanger and to the accumulator. A fluid conduit circulates the working fluid and establishes fluid communication between the accumulator, the compressor, the first heat exchanger, liquid-to-suction heat exchanger, the first expansion device, the receiver, the second expansion device, and the second heat exchanger through which the working fluid circulates.

In certain aspects, the liquid-to-suction heat exchanger receives the multiphase or liquid condensate stream from the first heat exchanger in a first flow direction and the vaporized stream from the second heat exchanger in a second flow direction to transfer heat therebetween.

In certain aspects, the climate control system is free of any pumps.

In certain aspects, the climate control system further comprises a liquid bypass line that diverts a portion of the working fluid exiting the receiver into the accumulator.

In certain further aspect, the liquid bypass line further comprises a liquid metering valve.

In certain aspects, the climate control system comprises a vapor bypass line that diverts a portion of the working fluid exiting the compressor into the receiver.

In certain aspects, the first refrigerant and the second refrigerant are selected from the group consisting of: carbon dioxide (R-744), chlorodifluoromethane (R-22), 1,1,1,2-tetrafluoroethane (R-134A), R-410A (a near-azeotropic mixture of difluoromethane (R-32) and pentafluoroethane (R-125), 1,1-difluoroethane (R-152A), dimethyl ether (R-E170), propane (R-290), 2,3,3,3,-tetrafluoroprop-1-ene (R-1234yf), cis- and trans-1,3,3,3,-tetrafluoropropene (HFO-1234ye), cis- and trans-1,3,3,3,-tetrafluoroprop-1-ene (R-1234ze), 3,3,3,-trifluoropropene (HFO-1234zf), trifluoro, monochloropropenes (HFO-1233), trans-1-chloro-3,3,3-trifluoropropene (HFO-1233zd(E)), cis-1-chloro-3,3,3-trifluoropropene (HFO-1233zd(Z)), 2-chloro-3,3,3-trifluoropropene (HFO-1233xf), trans-1,1,1,4,4,4-hexafluoro-2-butene (HFO-1336mzz(Z)), cis-1,1,1,4,4,4-hexafluoro-2-butene (HFO-1336mzz(E)), pentafluoropropenes (HFO-1225), 1,1,3,3,3-pentafluoropropene (HFO-1225zc), 1,2,3,3,3-pentafluoropropene (HFO-1225yez), hexafluorobutenes (HFO-1336), cis-1,1,1,4,4,4-hexafluoro-2-butene (HFO-1336mzz(Z)), trans-1,1,1,4,4,4-hexafluoro-2-butene (R-1336mzz(E)), trans-1,2-difluoroethene (R-1132(E)), and any isomers or combinations thereof.

In certain aspects, the first refrigerant comprises carbon dioxide (R-744), and the second refrigerant comprises a hydrofluorolefin.

In certain aspects, the working fluid further comprises a lubricant that has a first solubility for the first refrigerant that is greater than a second solubility the lubricant has for the second refrigerant.

In certain other aspects, the present disclosure relates to a method for operating a climate control system that circulates a working fluid comprising a refrigerant blend having high glide. The method comprises pressurizing a vapor stream of the working fluid by passing it through a compressor in a fluid conduit. At least a portion of the working fluid is condensed in a first heat exchanger disposed downstream of the compressor. The method also comprises cooling the working fluid by passing through a liquid-to-suction heat exchanger in a first flow direction and reducing pressure of the working fluid by passing through a first expansion device disposed downstream of the liquid-to-suction heat exchanger and the first heat exchanger. The method includes passing the working fluid from the first expansion device into a receiver and then further reducing pressure of the working fluid exiting the receiver by passing through a second expansion device disposed downstream of the receiver. The method also comprises evaporating at least a portion of the working fluid in a second heat exchanger disposed downstream of the second expansion device and heating the working fluid exiting the second heat exchanger by passing through the liquid-to-suction heat exchanger in a second flow direction. The method comprises passing the working fluid into an accumulator upstream of the compressor, so that the vapor stream of the working fluid exits the accumulator and enters the compressor, where the working fluid comprises the refrigerant blend having high glide that comprises a first refrigerant and a second refrigerant, wherein a difference in boiling points between the first refrigerant and the second refrigerant is greater than or equal to about 25°R (about 14K) at atmospheric pressure.

In certain aspects, the method comprises controlling concentrations of the first refrigerant and the second refrigerant in the refrigerant blend in the climate control system by (i) adjusting a first stored amount of liquid in the receiver; (ii) adjusting a second stored amount of liquid in the accumulator; or (iii) both (i) and (ii).

In certain aspects, the first refrigerant has a first critical point that is less than a second critical point of the second refrigerant and the method comprises controlling concentrations of the refrigerant blend in the climate control system by one or more of: (i) adjusting a first stored amount of the first refrigerant as a liquid in the receiver; (ii) adjusting a second stored amount of the second refrigerant as a liquid in the accumulator; or (iii) both (i) and (ii).

In certain aspects, the method comprises controlling concentrations of the first refrigerant and the second refrigerant in the refrigerant blend in the climate control system by adjusting a stored amount of liquid in the accumulator.

In certain aspects, the heating of the working fluid exiting the second heat exchanger by passing through the liquid-to-suction heat exchanger in the second flow direction adjusts the working fluid to have a superheated level that is either positive or negative as it enters the accumulator (ahead of the pressurizing in the compressor), wherein the superheated level adjusts a stored amount of liquid in the accumulator.

In certain aspects, the method further comprises diverting a portion of the working fluid exiting the receiver into a liquid bypass line that directs the portion of the working fluid into the accumulator.

In certain further aspects, the liquid bypass line further comprises a liquid metering valve that regulates flow of the working fluid in the liquid bypass line.

In certain aspects, the method further comprises diverting a portion of the working fluid exiting the compressor into a vapor bypass line that directs the portion of the working fluid into the receiver.

In certain aspects, the refrigerant blend having high glide defines a full phase change for condensation and the condensing only partially condenses the working fluid to a liquid phase and permits only a portion of the full phase change to occur, so that after the condensing, the second refrigerant is predominantly liquid, while a portion of the first refrigerant is liquid and a portion of the first refrigerant remains as vapor as it enters the liquid-to-suction heat exchanger.

In certain aspects, the refrigerant blend having high glide defines a defines a full phase change for evaporation and the evaporating only partially evaporates the working fluid to a vapor phase and permits only a portion of the full phase change to occur, so that after the evaporating, the first refrigerant is vapor, while a portion of the second refrigerant is vapor and a portion of the second refrigerant remains as liquid as it enters the liquid-to-suction heat exchanger.

In certain aspects, the condensing only partially condenses the working fluid to a liquid phase and the evaporating only partially evaporates the working fluid to a vapor phase.

In certain aspects, the first refrigerant and the second refrigerant are selected from the group consisting of: carbon dioxide (R-744), chlorodifluoromethane (R-22), 1,1,1,2-tetrafluoroethane (R-134A), R-410A (a near-azeotropic mixture of difluoromethane (R-32) and pentafluoroethane (R-125), 1,1-difluoroethane (R-152A), dimethyl ether (R-E170), propane (R-290), 2,3,3,3,-tetrafluoroprop-1-ene (R-1234yf), cis- and trans-1,3,3,3,-tetrafluoropropene (HFO-1234ye), cis- and trans-1,3,3,3,-tetrafluoroprop-1-ene (R-1234ze), 3,3,3,-trifluoropropene (HFO-1234zf), trifluoro, monochloropropenes (HFO-1233), trans-1-chloro-3,3,3-trifluoropropene (HFO-1233zd(E)), cis-1-chloro-3,3,3-trifluoropropene (HFO-1233zd(Z)), 2-chloro-3,3,3-trifluoropropene (HFO-1233xf), trans-1,1,1,4,4,4-hexafluoro-2-butene (HFO-1336mzz(Z)), cis-1,1,1,4,4,4-hexafluoro-2-butene (HFO-1336mzz(E)), pentafluoropropenes (HFO-1225), 1,1,3,3,3-pentafluoropropene (HFO-1225zc), 1,2,3,3,3-pentafluoropropene (HFO-1225yez), hexafluorobutenes (HFO-1336), cis-1,1,1,4,4,4-hexafluoro-2-butene (HFO-1336mzz(Z)), trans-1,1,1,4,4,4-hexafluoro-2-butene (R-1336mzz(E)), trans-1,2-difluoroethene (R-1132(E)), and any isomers or combinations thereof.

In certain aspects, the first flow direction and the second flow direction are countercurrent within the liquid-to-suction heat exchanger.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
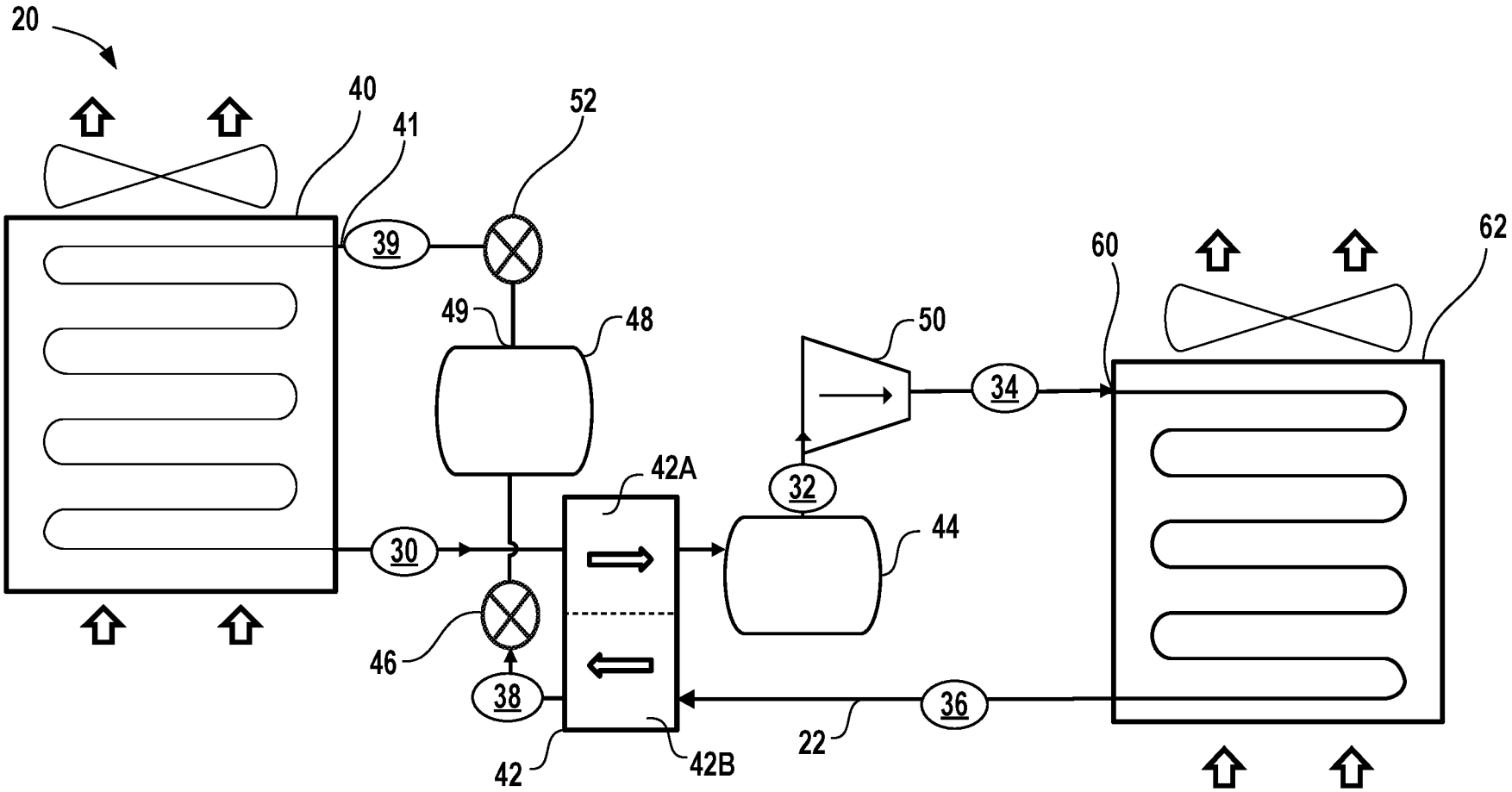
FIG. 1 shows a schematic of an example embodiment of a climate control system for circulating a working fluid having blended refrigerants that exhibits high glide prepared in accordance with certain aspects of the present disclosure that includes a liquid-to suction heat exchanger, an accumulator, and a receiver.

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, compositions, steps, integers, operations, and/or components, but do not preclude the presence or addition of one or more other features, integers, steps, operations, elements, components, and/or groups thereof. Although the open-ended term "comprising," is to be understood as a non-restrictive term used to describe and claim various embodiments set forth herein, in certain aspects, the term may alternatively be understood to instead be a more limiting and restrictive term, such as "consisting of" or "consisting essentially of." Thus, for any given embodiment reciting compositions, materials, components, elements, features, integers, operations, and/or process steps, the present disclosure also specifically includes embodiments consisting of, or consisting essentially of, such recited compositions, materials, components, elements, features, integers, operations, and/or process steps. In the case of "consisting of," the alternative embodiment excludes any additional compositions, materials, components, elements, features, integers, operations, and/or process steps, while in the case of "consisting essentially of," any additional compositions, materials, components, elements, features, integers, operations, and/or process steps that materially affect the basic and novel characteristics are excluded from such an embodiment, but any compositions, materials, components, elements, features, integers, operations, and/or process steps that do not materially affect the basic and novel characteristics can be included in the embodiment.

Any method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

When a component, element, or layer is referred to as being "on," "engaged to," "connected to," or "coupled to" another element or layer, it may be directly on, engaged, connected or coupled to the other component, element, or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various steps, elements, components, regions, layers and/or sections, these steps, elements, components, regions, layers and/or sections should not be limited by these terms, unless otherwise indicated. These terms may be only used to distinguish one step, element, component, region, layer or section from another step, element, component, region, layer or section. Terms such as "first," "second," and other numerical terms when used herein do not imply a sequence or order unless clearly indicated by the context. Thus, a first step, element, component, region, layer or section discussed below could be termed a second step, element, component, region, layer or section without departing from the teachings of the example embodiments.

Spatially or temporally relative terms, such as "before," "after," "inner," "outer," "beneath," "below," "lower," "above," "upper," and the like, may be used herein for ease of description to describe one element or feature's relationship to another element(s) or feature(s) as illustrated in the figures. Spatially or temporally relative terms may be intended to encompass different orientations of the device or system in use or operation in addition to the orientation depicted in the figures.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. For example, "about" may comprise a variation of less than or equal to 5%, optionally less than or equal to 4%, optionally less than or equal to 3%, optionally less than or equal to 2%, optionally less than or equal to 1%, optionally less than or equal to 0.5%, and in certain aspects, optionally less than or equal to 0.1%.

In addition, disclosure of ranges includes disclosure of all values and further divided ranges within the entire range, including endpoints and sub-ranges given for the ranges.

Example embodiments will now be described more fully with reference to the accompanying drawings.

In various aspects, the present disclosure pertains to climate control systems and methods of operating such systems that provide an ability to use working fluids having refrigerant blends that exhibit extreme glide during operation. In various aspects, the present disclosure contemplates a climate control system, such as a heating, ventilation, air conditioning, and refrigeration (HVAC/R) system that enables the use of a refrigerant blend with distinct refrigerants with substantially different critical temperature where concentration of the respective refrigerants in the system varies. In taking advantage of such extreme glide, the climate control system advantageously can be capacity modulated. In certain aspects of the present disclosure, a "working fluid" composition for a refrigeration system for a heat transfer device, such as a compressor machine, includes a blend of at least two refrigerant(s). Certain refrigerant blends may suffer from fractionation and high glide, which traditionally have been considered problems to be avoided in climate control systems. Many refrigerant blends exhibit temperature glide when they undergo phase changes in both the evaporator and condenser. As noted above, in the evaporator, the refrigerant evaporates or undergoes a phase change from a liquid to a vapor. In the condenser, the refrigerant condenses or undergoes a phase change from a vapor to a liquid. Refrigerant blends exhibit temperature glide, because there are multiple refrigerant molecules present with different properties. As these refrigerant blends change phase (evaporate and condense), a change in the refrigerant blend composition is observed due to preferential evaporation or condensation of the more or less volatile refrigerant components (also referred to as high-pressure and low-pressure refrigerants) in the blend of the refrigerants. This process is referred to as blend fractionation. Thus, a total temperature glide of a refrigerant blend may be defined as a difference in temperature between a saturated vapor temperature and a saturated liquid temperature at a constant pressure. Stated in another way, glide may be considered to be a temperature difference between the starting and ending temperature of a refrigerant phase change within a system at a constant pressure.

Thus, in certain aspects, a concentration of the refrigerant blend may be varied in the system by changing either (i) a stored quantity of a high-critical point rich blend as liquid in an accumulator or (ii) a stored quantity of a low-critical point rich blend as a liquid in a receiver. For example, in certain aspects, using superheating and sub-cooling approaching a compressor provides control over changes in stored amounts of liquid in/level of an accumulator. In certain variations, as the refrigerant blend has a high glide weighted toward high vapor quality, when the blend comprises a plurality of low-critical point fluids, the system includes a heat exchanger (for example, a liquid-suction heat exchanger) to limit the operation of glide in the evaporator and sub-cool the temperature of the high-pressure liquid leaving the evaporator.

The working fluid can be modified in operation by further adding a lubricant having preferential affinity, for example, a greater solubility, to at least one refrigerant to change the refrigerant blend concentration in circulation in the system. Working fluids for refrigeration systems generally include a minor amount of the lubricant composition, where the lubricant and refrigerant(s) are combined in amounts so that there is relatively more refrigerant than lubricant in the lubricant-refrigerant compositions.

Based on the combined weight of lubricant and refrigerant, the refrigerant is greater than or equal to about 50% by weight and the lubricant is less than or equal to about 50% by weight of the combined weight. In various embodiments, the lubricant oil is greater than or equal to about 1 to less than or equal to about 30% by weight of the combined weight of lubricant and high energy refrigerant of from greater than or equal to about 5 to less than or equal to about 20% by weight of the combined weight of the working fluid. Typically, the working fluids include greater than or equal to about 5 to less than or equal to about 20 weight % or optionally greater than or equal to about 5 to less than or equal to about 15 weight % of lubricant with a balance being the refrigerant(s). In the context of the present disclosure, the working fluid may comprise at least two distinct refrigerants that form a blend of refrigerant compositions.

In the context of certain aspects of the present technology, counterintuitively, a working fluid is intentionally selected that has a high glide refrigerant blend. As will be described herein, the respective refrigerants in the refrigerant blend may be selected for environmental characteristics like global warming potential, decomposition products that avoid trifluoroacetic acid (TFA) or other per- and polyfluoroalkyl substances (PFAS), or for their ability to outperform traditional refrigerants in energy efficiency. Thus, the high glide refrigerant blend may comprise environmentally friendly refrigerants (for example, including one or more A1 refrigerants). In certain aspects, the refrigerant blend may comprise a first refrigerant with a relatively low normal boiling point (also referred to herein as a high-pressure or low-critical point refrigerant) and a second refrigerant with a relatively high normal boiling point (also referred to herein as a low-pressure or high-critical point refrigerant).

In certain aspects, the first refrigerant may have a first (low) boiling point of greater than or equal to about −270° C. to less than or equal to about 8° C. Thus, the low boiling point refrigerant may have a boiling point in a range from hydrogen at −267° C. to R-1336mzz(E) at 7.5° C. In certain aspects, the second refrigerant may have a second (high) boiling point of greater than or equal to about −55° C. to less than or equal to about 100° C. For example, the high boiling point refrigerant can range from R-32 at approximately −52° C. to water ($H_2O$) at 100° C. As will be appreciated by those of skill in the art, the refrigerant components are selected to create a blend that meets the goals of the system in the application. A different blend may be selected for cryogenic applications, low temperature refrigeration, medium temperature refrigeration, air conditioning, and different process cooling applications, and the like.

Thus, the working fluid may comprise a first refrigerant and a second refrigerant having a difference in normal boiling points (e.g., ΔT=First Refrigerant Boiling Point ($BP_1$)−Second Refrigerant Boiling Point ($BP_2$)) of greater than or equal to about 25°R (about 14° K) at atmospheric pressure. The first refrigerant and a second refrigerant may be chosen for various properties, including respective normal boiling points, glide efficiency, global warming potential, environmental impact, such as polyfluoroalkyl substances (PFAS) impact, capacity, pressure, safety, and the like. In certain aspects, the difference in normal boiling points between the first refrigerant and the second refrigerant is greater than or equal to about 50°R (28K), optionally greater than or equal to about 75°R (42K), optionally greater than or equal to about 100°R (55K), optionally greater than or equal to about 125° F. (69K), and in certain aspects, optionally greater than or equal to about 150°R (83K) at atmospheric pressure.

By way of example, the present disclosure contemplates employing refrigerant blends comprising at least one refrigerant that has a low global warming potential, such as ASHRAE classified A1, A2, and A2L refrigerants. In certain aspects, the refrigerant blend comprises an A1 refrigerant. As noted above, examples of A1 refrigerants include carbon dioxide (R-744), chlorodifluoromethane (R-22), 1,1,1,2-tetrafluoroethane (R-134A), and R-410A (a near-azeotropic mixture of difluoromethane (R-32) and pentafluoroethane (R-125)), and trifluoro, monochloropropenes (R-1233), including cis- and trans-1-chloro-3,3,3-trifluoropropene (HFO-1233zd) isomers (HFO-1233zd(Z) and HFO-1233zd (E)), and hexafluorobutenes (HFO-1336, including HFO-1336mzz(Z), 1336mzz(E)). In certain aspects, the refrigerant blend comprises an A2 refrigerant. As noted above, an example of an A2 refrigerant includes 1,1-difluoroethane (R-152A). Many suitable HFO refrigerants are described in U.S. Pat. No. 4,788,352 to Smutny and U.S. Pat. No. 8,444,874 to Singh et al., the relevant portions of which are incorporated herein by reference. The HFOs may include 2,3,3,3,-tetrafluoroprop-1-ene (HFO-1234yf) and trans-1,3,3,3,-tetrafluoroprop-1-ene (HFO-1234ze). Non-limiting suitable examples of specific HFO refrigerants include 3,3,3,-trifluoropropene (HFO-1234zf), HFO-1234 refrigerants like 2,3,3,3,-tetrafluoropropene (HFO-1234yf), 1,2,3,3,-tetrafluoropropene (HFO-1234ze), cis- and trans-1,3,3,3,-tetrafluoropropene (HFO-1234ye), pentafluoropropenes (HFO-1225) such as 1,1,3,3,3, pentafluoropropene (HFO-1225zc), hexafluorobutenes (HFO-1336), such as cis-1,1,1,4,4,4-hexafluoro-2-butene (HFO-1336mzz-Z) and trans-1,1,1,4,4,4-hexafluoro-2-butene (R-1336mzz(E)), or those having a hydrogen on the terminal unsaturated carbon such as 1,2,3,3,3, pentafluoropropene (HFO-1225yez), fluorochloropropenes such as trifluoro, monochloropropenes (HFO-1233) like $CF_3CCl{=}CH_2$ (HFO-1233xf) and $CF_3CH{=}CHCl$ (HFO-1233zd) (including trans(E) and cis (Z) isomers (HFO-1233zd(E) and HFO-1233zd(Z)),(E)-1,2-difluoroethene (R-1132(E)), and any combinations thereof. In certain aspects, the HFO refrigerant may be selected from the group consisting of: R-1234yf, R-1234ze, R-1233zd(E), R-1233zd(Z), R-1336mzz(Z), R-1336mzz(E), R-1132(E), and combinations thereof.

According to certain variations, at least one refrigerant in the working fluid refrigerant blend used with present technology may comprise a refrigerant selected from the group consisting of: R-744, R-22, R-134A, R-410A, R-1234yf, R-1234ze, R-1233zd(E), R-1233zd(Z), R-1336mzz(Z), R-1336mzz(E), R-152A, and combinations thereof.

In certain aspects, the first refrigerant and the second refrigerant are independently selected from the group consisting of: carbon dioxide (R-744), chlorodifluoromethane (R-22), 1,1,1,2-tetrafluoroethane (R-134A), R-410A (a near-azeotropic mixture of difluoromethane (R-32) and pentafluoroethane (R-125), dimethyl ether (R-E170), difluoromethane (R-32), hydrofluorolefins (HFOs), dimethyl ether (R-E170), propane (R-290), 1,1-difluoroethane (R-152A), and combinations thereof.

The refrigerants may be used in combination with other A1, A2, or A2L refrigerants or yet other refrigerants, such or A3 or B1 or B2 refrigerants, including natural or flammable refrigerants (e.g., dimethyl ether (R-E170), propane ($C_3H_8$ or R-290)).

In certain variations, the first refrigerant is selected from the group consisting of: carbon dioxide (R-744), chlorodifluoromethane (R-22), 1,1,1,2-tetrafluoroethane (R-134A), R-410A (a near-azeotropic mixture of difluoromethane (R-32) and pentafluoroethane (R-125), dimethyl ether (R-E170), difluoromethane (R-32), hydrofluorolefins (HFOs), and combinations thereof, while the second refrigerant is selected from the group consisting of: 2,3,3,3,-tetrafluoroprop-1-ene (R-1234yf), 1,3,3,3,-tetrafluoroprop-1-ene (R-1234ze), 1-chloro-3,3,3-trifluoropropene (HFO-1233zd(E), 1-chloro-3,3,3-trifluoropropene (HFO-1233zd (Z), HFO-1233zd(Z))1,1,1,4,4,4-hexafluoro-2-butene (HFO-1336mzz), and combinations thereof.

In certain aspects, the refrigerant blend includes an A1 refrigerant, carbon dioxide (R-744), mixed with at least one other refrigerant. The carbon dioxide refrigerant is desirably used in a sub-critical system design. One example of a suitable, non-limiting refrigerant blend includes $CO_2$ (R-744) as the more volatile, high-pressure refrigerant mixed with R-1234yf as the less volatile, low-pressure fluid. In such an example, the refrigerant blend has a first refrigerant comprising $CO_2$ with a normal boiling point (at 1 atmosphere (atm.) of pressure) of approximately −78° C. and a second refrigerant comprising R-1234yf with a normal boiling point of approximately −29° C. at 1 atm. of pressure, so that a difference in boiling points is about 88°R (49K).

In another variation, the refrigerant blend may include an A1 refrigerant, such as $CO_2$ (R-744) mixed with a flammable refrigerant (ASHRAE 34 class A3) such as propane ($C_3H_8$ or R-290) or dimethyl ether (R-E170). In this example, the refrigerant blend has a first refrigerant comprising $CO_2$ with a normal boiling point of approximately −78° C. and a second refrigerant comprising R-E170 with a normal boiling point of approximately −24° C., so that a difference in boiling points is about 97.2°R (54K). As described further below, the climate control system can maintain a ratio of A1 refrigerant to limit the amount of flammable refrigerant on the indoor side of the system to a safe level.

While an amount of refrigerant present in the working fluid may vary at different points in the system and may be based on particular system requirements, in certain variations, the working fluid charged into the system may include a first refrigerant that may be a more volatile, high-pressure/low-critical point refrigerant present at greater than or equal to about 5% by weight to less than or equal to about 95% by weight and the second refrigerant may be a less volatile, low-pressure/high-critical point refrigerant that is present at greater than or equal to about 5% by weight to less than or equal to about 95% by weight based on the combined weight of all refrigerants. In one example, the working fluid does not need to have a large quantity of a fluid with a lower critical point, namely the second refrigerant, blended with a first refrigerant, such as $CO_2$ (R-744), to advantageously keep the $CO_2$ out of a transcritical operating regime. In certain variations, the first refrigerant may be a more volatile, high-pressure refrigerant present at greater than or equal to about 50% by weight and the second refrigerant may be a less volatile, low-pressure refrigerant that is present at less than or equal to about 50% by weight based on the combined weight of all refrigerants.

In this manner, fractionation may be a phenomenon that enables a variable blend refrigerant, so that fractionation can be used in the climate control system, for example by use of heat exchangers (e.g., evaporator and condensers) and/or storage vessels to separate streams into different concentrations. Thus, the refrigerant flow may allow only a small portion of a phase change to occur in each heat exchanger. Only a portion of the total glide is experienced in partial phase change.

As will be described in more detail below, refrigeration lubricant oils known to be suitable for use with such refrigerants are contemplated. The working fluid may comprise a synthetic oil. In certain variations, the lubricant oil may comprise a polyvinyl ether (PVE) oil, a polyalphaolefin (PAO), a polyalkylene glycol (PAG), alkylbenzene, mineral oil, or an ester-based oil, such as polyol ester (POE) oil. In certain variations, for example, the lubricant oil may comprise a polyol ester (POE) compound formed from a carboxylic acid and a polyol. In certain variations, such a POE may be formed from a carboxylic acid selected from a group consisting of: n-pentanoic acid, 2-methylbutanoic acid, n-hexanoic acid, n-heptanoic acid, 3,3,5-trimethylhexanoic acid, 2-ethylhexanoic acid, n-octanoic acid, n-nonanoic acid, and isononanoic acid, and combinations thereof and a polyol selected from a group consisting of: pentaerythritol, dipentaerythritol, neopentyl glycol, trimethylpropanol, and combinations thereof. Where carbon dioxide (R-744) is present in the refrigerant blend, in certain variations, the lubricant may comprise a polyol ester oil (POE) oil. For example, one particularly suitable lubricant oil is a polyol ester oil designated 3MAF, which is a reaction product of pentaerythritol (nominally about 78% to 91% and dipentaerythritol (nominally about 9% to 22%)) polyols with carboxylic acids (valeric acid nominally at 29% to 34%, heptanoic acid nominally at 34% to 44%, and 3,5,5-trimethyl hexanoic acid nominally at 22% to 37%).

In various aspects, the climate control systems contemplated by the present disclosure provide the ability to use the extreme glide properties of a refrigerant blend during operation, which allows components to be isolated and stored in a concentrated state, which can then change the concentration of the blend at the compressor suction in order to enable high density gas compression for enhanced capacity and variable density gas compression for system capacity modulation, for example.

In certain aspects, methods of operating climate control systems may include using such a working fluid comprising at least a first refrigerant and a second distinct refrigerant, where the evaporation and condensation of the refrigerant blend/working fluid is only partial, thus resulting in a specialized vapor compression cooling/heating cycle.

A conventional thermodynamic climate control system such as, for example, a heat-pump system, a refrigeration system, or an air conditioning system configured to use a high glide refrigerant blend is contemplated by certain aspects of the present disclosure. In various aspects, the present disclosure pertains to climate control systems used in a wide variety of refrigeration and heat energy transfer applications, in some cases, to industrial or commercial air-conditioning or refrigeration units, e.g., for factories, office buildings, apartment buildings, warehouses, and ice skating rinks, or for retail sale.

FIG. 1 shows one variation of a vapor compression system 20 prepared in accordance with certain aspects of the present disclosure. Such a system is similar to a typical vapor compression circuit, whose main components include an evaporator, a condenser, and a compressor. However, as described herein, additional components in the system include an accumulator, a liquid-to-suction heat exchanger, a receiver, and at least one expansion valve, which as described herein provide the capability of taking advantage of the high glide refrigerant blend in the working fluid. For example, in the vapor compression system, the refrigerant blend in the working fluid is processed by varying a mass of liquid refrigerant in an accumulator and a receiver (or other vessels). As such, the vapor compression system provides an ability to change refrigerant blend by varying the mass of liquid refrigerant in an accumulator and a receiver (or other vessels). Further, superheating and sub-cooling the working fluid stream approaching the compressor is used to intentionally drive changes in a level of select refrigerants in the accumulator. To lower the level of liquid in a receiver, a condenser and liquid-suction heat exchanger bypass for discharge gas/vapor may be used. Alternatively, permitting higher subcooling at the entrance or inlet to the receiver will raise the level in the receiver. In other variations, a liquid bypass may be used to direct at least a portion of liquid of the refrigerant blend into the accumulator and thus avoiding the evaporator and liquid-to-suction heat exchanger.

By way of example, FIG. 1 shows a schematic of an example of a simplified climate control system 20, such as a refrigeration system, that processes and circulates a working fluid having a composition comprising at least a first refrigerant (A) and a second refrigerant (B) that exhibit high glide. The capacity of the climate control system 20 may be modulated by changing relative proportions of first refrigerant (A) and second refrigerant (B) in the working fluid blend at different points in the system. Therefore, a resulting density of the compressor suction is modified by preferentially storing concentrated amounts of first refrigerant (A) or second refrigerant (B) in one or more select regions of the system. In certain aspects, the present disclosure provides a vapor compression system that may be configured to incompletely evaporate and condense refrigerant.

As discussed above, more than two refrigerants may be present, but for simplicity, two refrigerants are used in this example and a difference in boiling points between the first refrigerant (A) and the second refrigerant (B) is greater than or equal to about 25°R at atmospheric pressure. The working fluid may also include oil(s) at certain points in the system, as will be described in greater detail below. The term "fluid" as used herein encompasses liquid, gas, and any combinations thereof, including vapor (e.g., a gas phase having aerosolized liquid droplets). The term gas or gas phase as used herein is intended to encompass both vapor and pure gas phases.

The climate control system 20 has a fluid flow path or fluid conduit 22 that establishes fluid communication between the various components, so that the working fluid may circulate in a loop as discussed further herein. First, the working fluid including the first refrigerant (A) and second refrigerant (B) may enter a first heat exchanger in the form of the evaporator 40. The evaporator 40 causes first refrigerant (A) and/or second refrigerant (B) to transform from a liquid phase to a gas or vapor phase as it exits the evaporator 40 at point 30, where the cooling effect of endothermic energy absorption occurs. The refrigerant(s) typically evaporate at a lower pressure withdrawing heat from the surrounding zone. Air flowing through the evaporator 40 is shown by arrows, which is cooled. As shown, the air flows in a countercurrent arrangement, although concurrent or other air flow configurations may also be used. The heat exchangers (evaporator 40 and condenser 62 discussed below) may include concentric, finned tube, brazed plate, plate and frame, microchannel, or other heat exchangers. There may be a single evaporator and condenser or multiple evaporators or condensers in parallel or series configurations. Refrigerant flow therein can be controlled via a capillary tube, thermostatic expansion valve, electric expansion valve, or other methods. In heat pump systems, the roles of the evaporator 40 and the condenser 62 may be changed based on whether heating or cooling of a space is being performed.

The evaporator 40 may be located in a room or space to be cooled by the climate control system 20 or used to cool air flowing into a room or space in which cooling is desired. Thus, the evaporator 40 receives and at least partially vaporizes the low-pressure multiphase working fluid at point 39 and directs the working fluid after point 30 to a downstream liquid-to-suction heat exchanger 42. More specifically, the low-pressure multiphase working fluid passes in a first flow direction indicated by the arrow within a first side 42A of the liquid-to-suction heat exchanger 42.

At point 30 in the fluid conduit 22, the working fluid comprises a combination of both first refrigerant (A) and second refrigerant (B) that are partially or fully in gas phase. Working fluid at point 30 may be a multiphase composition. As noted above, one aspect of the present technology is that the working fluid having the refrigerant blend with first refrigerant (A) and second refrigerant (B) may only be partially evaporated to form a mixture of both gas/vapor and liquid. For example, the first refrigerant (A) may have a lower boiling point/lower critical point and is thus more volatile, so a greater amount of first refrigerant (A) volatizes or evaporates, while second refrigerant (B) has a higher boiling point/higher critical point and thus a lower proportion of second refrigerant (B) evaporates or volatilizes in the working fluid and thus a larger proportion remains in liquid form. By way of example, the vapor quality, or mass fraction of vapor of the working fluid at point 30 that exits the evaporator may be predetermined to be any amount, for example from greater than or equal to about 15% to about 100% vapor quality, by way of non-limiting example, depending on an amount of liquid evaporated.

Thus, a portion of the working fluid in conduit 22 at point 30 may include the second refrigerant (B) in liquid form. The working fluid passes into the first side 42A of the liquid-to-suction heat exchanger 42 in a first flow direction and heat will be transferred with a distinct stream of the working fluid passing in a second flow direction of a second side 42B of the liquid-to-suction heat exchanger 42. The first flow direction and the second flow direction of the streams of working fluid within the liquid-to-suction heat exchanger 42 may be in a counter-current heat transfer relationship, co-current heat transfer relationship, or the like.

Generally, the liquid-to-suction heat exchanger 42 transfers heat between the relatively hot condensate liquid exiting the condenser 62 and colder biphasic fluid exiting the evaporator 40. More specifically, the hotter condensate liquid can increase the temperature and vapor quality of the stream exiting from the evaporator in a liquid-suction heat exchanger to provide a higher level of sub-cooling (or a lower temperature and lower vapor quality) of the condensate effluent to increase the evaporator capacity. Thus, the liquid-to-suction heat exchanger 42 can provide certain advantages in the climate control system 20, including further cooling the liquid refrigerant prior to it entering the evaporator 40, which can increase system efficiency, can reduce possible flashing in the liquid line and enable the expansion valve(s) to operate with greater stability. In this manner, the partially evaporated refrigerant is further evaporated by heat transfer with slightly warmer partially condensed (or performs subcooling of) refrigerant from the same cycle. Further, the suction to liquid-to-suction heat exchanger 42 does not superheat the suction gas in certain variations.

In certain aspects, an amount of heat transferred by the liquid-to-suction heat exchanger 42 is expressed by a difference in temperature ($\Delta T$) between a first temperature ($T_1$) of the working fluid at point 36 and a second temperature ($T_2$) of the working fluid at point 30. In certain variations, a difference between the first temperature ($T_1$) at point 36 and the second temperature ($T_2$) at point 30 may be greater than or equal to about 5K (or 9°R, where the second temperature $T_2$ is at least about 5K below the first temperature $T_1$), optionally greater than or equal to about 10K (18°R), optionally greater than or equal to about 15K (27°R), optionally greater than or equal to about 20K (36°R), optionally greater than or equal to about 30K (54°R), optionally greater than or equal to about 40K, optionally greater than or equal to about 50K (90°R), optionally greater than or equal to about 60K (108°R), optionally greater than or equal to about 70K (126°R), optionally greater than or equal to about 80K (144°R), optionally greater than or equal to about 90K (162°R), and in certain variations, optionally greater than or equal to about 100K (180°R).

After exiting the first side 42A of the liquid-to-suction heat exchanger 42, the working stream may be at near-saturated vapor conditions and enters a storage vessel or tank in the form of an accumulator 44 receives the working fluid that may include the working fluid in both a vapor and liquid phase. More specifically, the vapor phase of the working fluid in the accumulator 44 includes gas or vapor phase refrigerants, including substantially more of the volatile/low critical point first refrigerant (A) and optionally, a portion of the less volatile/high critical point second refrigerant (B), depending on desired operating conditions. The liquid phase may comprise the second refrigerant (B) in a liquid phase, for example, in certain variations, a majority of the liquid phase may be second refrigerant (B). As discussed below, the accumulator 44 stores or holds liquid phase refrigerant(s), while saturated vapor refrigerant(s) are returned to the compressor 50. In certain aspects, the accumulator 44 may be sized based on suction volume flow and by how much refrigerant may be stored therein. A level of the accumulator 44 can be adjusted, either by raising or lowering, as follows. Superheat can drive the change of level. For example, the heating of the working fluid exiting the liquid-to-suction heat exchanger adjusts the working fluid to have a superheated level that is either positive or negative as it enters the compressor during the condensing, where the superheated level adjusts a stored amount of liquid in the accumulator 44. With the high glide of the refrigerant, measurable negative refrigerant will describe a state where liquid is being added to the accumulator 44. Positive superheat will result in the boiling/evaporation of refrigerant from the accumulator 44 into the suction flow stream (e.g., at point 32) thus reducing the liquid stored in the accumulator.

The stream of working fluid exiting the accumulator 44 at point 32 may be predominantly or entirely in the vapor phase, and thus referred to as a vapor stream, that passes into a compressor 50 where it is compressed to increase pressure and form a high-pressure vapor or gas stream 34 exiting the compressor 50. The compressor 50 may be a variety of different compressors known in the art. Types of compressors useful for the above application can be classified into two broad categories, both positive displacement and dynamic compressors. Positive displacement compressors increase refrigerant vapor pressure by reducing the volume of the compression chamber through work applied to the compressor's mechanism. Positive displacement compressors include many styles of compressors currently in use, such as reciprocating, rotary (rolling piston, rotary vane, single screw, twin screw), and orbital (scroll or trochoidal). Dynamic compressors increase refrigerant vapor pressure by continuous transfer of kinetic energy to the vapor in a compression mechanism in the form of a rotating member, followed by conversion of this energy into a pressure rise. Centrifugal compressors function based on these principles. Details of the design and function of these compressors for refrigeration applications can be found in the 2010 ASHRAE Handbook, HVAC systems and Equipment, Chapter 37, incorporated herein by reference. In certain variations, the compressor 50 may be a scroll compressor or a reciprocating compressor, by way of example.

A high-pressure or pressurized gas stream 34 of the working fluid exiting the compressor 50 has a pressure that is significantly greater than the pressure of vapor stream 32. The mechanical energy required for compressing the vapor and pumping the fluid in the compression mechanism of the compressor is provided by, for example, an electric motor or internal combustion engine. Notably, in certain aspects, the climate control system 20 provides a turndown without requiring traditional compressor modulation techniques by changing a density of the refrigerants in the working fluid at the inlet of the compressor 50.

The condenser 62 is thus disposed downstream of the compressor 50 and thus receives and cools the pressurized gas stream 34 at condenser inlet 60 and may generate a multiphase condensate stream 36 of the working fluid. The working fluid thus enters the inlet 60 of condenser 62 as a gas, which is partially or completely condensed to a near-saturated liquid as it exits the condenser 62 at point 36. The vapor quality, or mass fraction of vapor of the working fluid (liquid stream at point 36) that exits the condenser 62 may be in an amount ranging from 0% to less than or equal to about 25% vapor quality, such as 10% vapor quality, optionally 5% vapor quality, optionally 1% vapor quality, and the like, by way of non-limiting example.

In the condenser 62, pressurized gas stream 34 transforms from a vapor phase to a liquid phase (for example, first refrigerant (A) transforms from vapor to liquid). In the condenser 62, the working fluid is cooled by condensing that expels heat from the climate control system 20, as shown by the arrows reflecting airflow. The condenser 62 may be located in a room or space where heat may be expelled, for example, outdoors. As noted above, one aspect of the present technology is that the working fluid having the refrigerant blend with first refrigerant (A) and second refrigerant (B) may be only partially condensed to form a multiphase mixture of both liquid and optionally gas/vapor.

After passing through the condenser 62, the working fluid is a high-pressure liquid stream 36. The high-pressure liquid stream 36 of working fluid passes into the second side 42B of the liquid-to-suction heat exchanger 42 in a second flow direction and heat will be transferred with the distinct stream of the working fluid passing in the first flow direction in the first side 42A of the liquid-to-suction heat exchanger 42, with the heat transfer relationship as discussed above. As shown, the second flow direction is indicated by an arrow and is in a countercurrent heat exchange configuration with the first flow direction. Thus, the working fluid exiting the condenser 62 may be near-saturated or saturated liquid, which is completely condensed and subcooled, within the liquid-to-suction heat exchanger 42.

After exiting the second side 42B of the liquid-to-suction heat exchanger 42, the working fluid is a condensate at point 38, which is then circulated in fluid conduit 22 through a first expansion device, such as a first expansion valve 46. The first expansion valve 46 is disposed between the liquid-to-suction heat exchanger 42 and a second storage vessel in the form of a receiver 48. In certain aspects, the receiver 48 may be sized based on how much refrigerant may be stored therein. In contrast to a gas-liquid flat tank, the pairing of the receiver 48 and the accumulator 44 in the climate control system 20 does not require any separate pressurization and the pair of receiver 48 and accumulator 44 can handle all of the high glide refrigerant flow that will be circulated through the system 20. At the first expansion valve 46, the pressure of the working fluid is reduced. In this manner, the working fluid steam is subcooled in the liquid-to-suction heat exchanger 42 followed by a reduction in pressure as it passes through the first expansion valve 46.

The reduced pressure working fluid stream exiting the first expansion valve 46 thus enters the receiver 48, where vapor and liquid are separated and liquid circulating through the system may be stored and concentrated. The receiver 48 thus receives the working fluid that may include the working fluid in both a vapor and liquid phase, however, is predominantly in a liquid phase. More specifically, the working fluid in the receiver 48 may include includes liquid phase refrigerants, including substantially more of the less volatile/high critical point second refrigerant (B) and optionally, a portion of the more volatile/low critical point first refrigerant (A), depending on desired operating conditions. The liquid phase may comprise the second refrigerant (B) in a liquid phase, for example, in certain variations, a majority of the liquid phase may be second refrigerant (B). The vapor quality, or mass fraction of vapor of the working fluid (liquid stream at point 36) that exits the receiver may be in an amount ranging from 0% to less than or equal to about 10% vapor quality, such as 5% vapor quality, optionally 3% vapor quality, optionally 1% vapor quality, and the like, by way of non-limiting example. The reduced pressure working stream exiting the first expansion valve 46 thus enters the receiver 48. The liquid refrigerant continues along the path exiting through an outlet 49 (while not shown, this can be positioned at the bottom of the vessel) so that liquid is drawn out of the receiver 48 as a saturated liquid at a concentration consistent with the fluid circulating the system 20. More specifically, the working fluid in the liquid portion of the receiver 48 includes a saturated liquid will define a portion of the less volatile/high critical point second refrigerant (B) and a portion of the more volatile/low critical point first refrigerant (A) that will continue to flow through the components of the system 20 until reaching the accumulator 44.

After exiting receiver 48, the working fluid passes through a second expansion device, such as a second expansion valve 52. The second expansion valve 52 further reduces pressure of the stream. Thus, the saturated working fluid leaving the receiver 48 is further expanded to a two-phase working fluid as it passes through the second expansion valve 52. The second expansion valve 52 is disposed between the receiver 48 and an inlet 41 to the evaporator 40. Thus, at point 39 the working fluid is a low-pressure multiphase stream that then enters the evaporator 40, so completing the refrigerant cycle. The two-phase working fluid thus enters the evaporator 40, where it may be partially boiled to a higher vapor quality fluid, as discussed above in the context of the properties of the working fluid at point 30 exiting the evaporator 40. The higher vapor quality working fluid at point 30 is further boiled in the first side 42A of the liquid-to-suction heat exchanger 42, for example, to a near-saturated vapor condition working fluid. As discussed above, the near-saturated vapor condition working fluid stream is thus returned to the accumulator 44, where liquid phase refrigerant(s) are held or stored, while saturated vapor refrigerant(s) are returned to the compressor 50.

As shown by the arrows in FIG. 1, the working fluid circulates in countercurrent flow arrangement to the flow of air as the heat transfer medium (e.g., ambient air) that passes through the evaporator 40 and condenser 62. A temperature range of the high glide refrigerant blend may be operated to be about 50% to about 200%, optionally about 66% to about 150% of the temperature range of the air circulated through the evaporator 40 and/or condenser 62. A direction of the refrigerant/working fluid flow in the conduit 22 is generally opposite to a flow direction of the air to accomplish the benefits of counter flow in a high glide system.

The flow of air through the evaporator 40 and condenser 62 may be lower than industry rules of thumb or standard flows, as the counter flow of temperature gliding refrigerant in conduit 22 reduces the impact that results from high temperature splits on the secondary fluid (air).

As will be appreciated by those of skill in the art, conventional components used with the climate control system 20 may not be shown, including flow rate, temperature, and pressure monitors, actuators, valves, controllers and the like. Further, it is noted that the climate control system 20 may be free of any conventional pumps and may be considered a "pump-less" design.

In this manner, the climate control system 20 permits control over the concentrations of respective refrigerants in a working fluid having high glide, by varying the mass of liquid refrigerant in an accumulator and a receiver (or alternatively, in other vessels). The climate control system thus efficiently allows a concentration of a refrigerant blend of components with very different critical temperatures (e.g., $CO_2$ at 87° F. and R-1233zd at 330° F.) to be varied. As a second refrigerant (e.g., R-1233zd) has a higher critical temperature (e.g., of over 330° F.), an overall critical temperature of the working fluid blend can be raised far above the critical temperature of the first refrigerant (e.g., above 87.8° F. critical temperature of $CO_2$). In this manner, the concentration can remain subcritical with optimized performance, as each ambient requires a unique circulation concentration. As noted above, in certain aspects, the concentration is varied by changing: (i) a stored quantity of a high-critical point rich blend as liquid in the accumulator and (ii) a stored quantity of a low-critical point rich blend as liquid in the receiver. Because the refrigerant blend has a high glide weighted toward high vapor quality when the blend comprises the low critical point fluid, the system incorporating a liquid-suction heat exchanger allows limiting the operation of glide in the evaporator and subcools the high-pressure liquid leaving the evaporator.

Further, by incorporating a liquid-to-suction heat exchanger, the working fluid may be adjusted to have positive or negative superheat approaching the compressor to drive changes in the accumulator level.

Thus, in certain aspects, efficiency gains in the climate control system are made possible by active control of the working fluid critical point, where liquid in the accumulator has a higher concentration of the high critical point/second refrigerant (B) (e.g., R-1233zd) with respect to a total amount of the working fluid. The liquid in the receiver has a lower concentration of the high critical point/second refrigerant (B) (e.g., R-1233zd) with respect to a total amount of the working fluid in the receiver when compared to the accumulator liquid. Thus, the refrigerant concentration is controlled by shifting liquid between the two vessels. In various aspects, refrigerant concentration only depends on a level of liquid in the accumulator. The changing level in the receiver provides a secondary location for refrigerant storage in the circulating concentration. Further, such an efficiency gain may also be due to compressor pressure/head reduction by combining a liquid-suction heat exchanger with a high glide working fluid having two distinct refrigerants. The liquid-suction heat exchanger allows condensation to occur at a higher enthalpy range than evaporation. Additionally, with the very high glide of the refrigerant blend, the inclusion of the liquid-suction heat exchanger allows condensation at a lower pressure and evaporation at a higher pressure. Further, by changing the liquid-to-suction heat exchanger capacity, capacity modulation of the system is contemplated. For example, the capacity is efficiently reduced through the reduction of compressor head as the enthalpy change across the evaporator is reduced.

Figure 2:
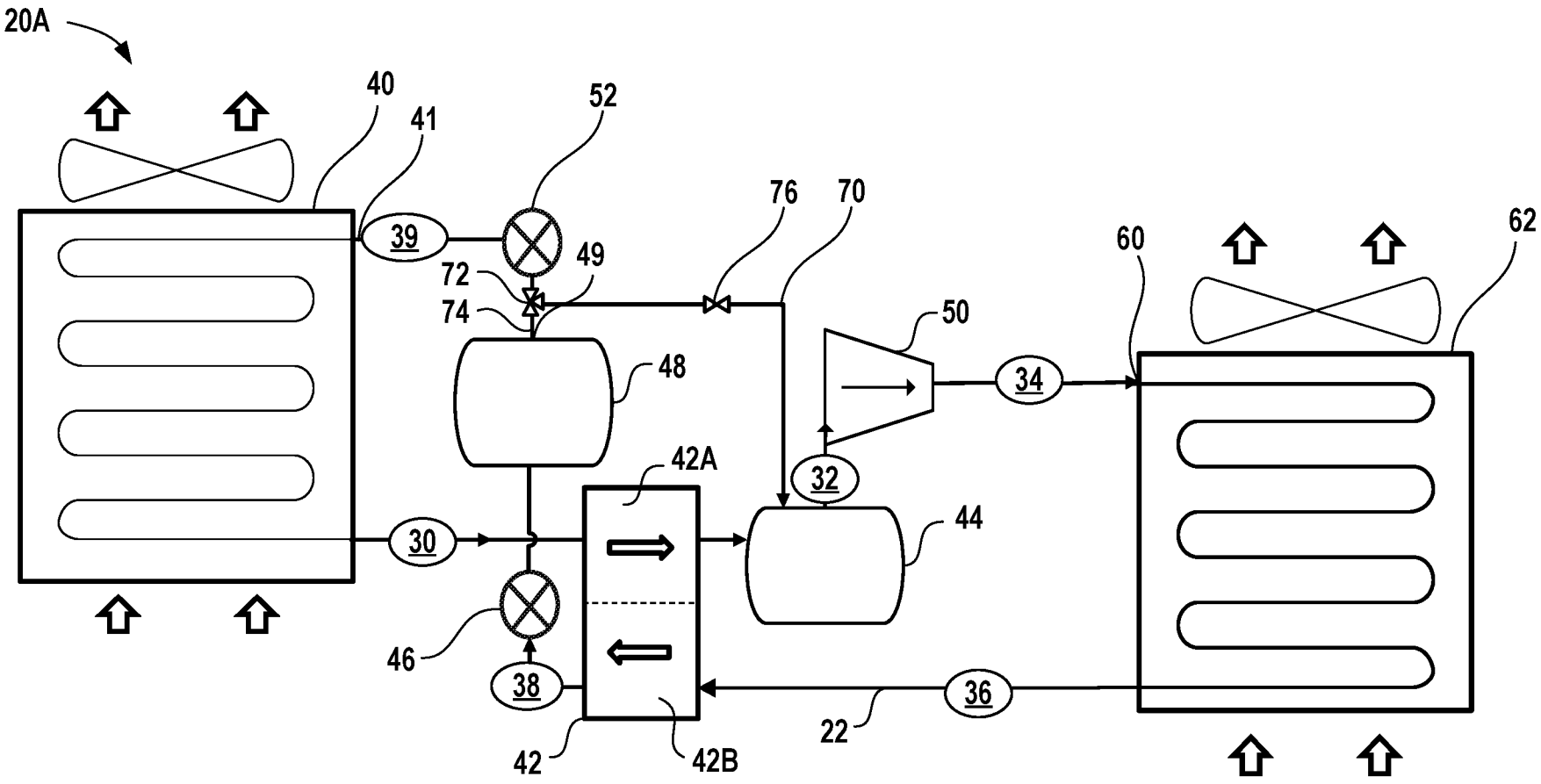
FIG. 2 shows a schematic of another example embodiment of a climate control system for circulating a working fluid having blended refrigerants that exhibits high glide prepared in accordance with certain aspects of the present disclosure that includes a liquid-to suction heat exchanger, an accumulator, a receiver and further includes a liquid bypass line.

In certain variations described herein, by using a liquid bypass line that bypasses an expansion valve and evaporator, a level of liquid in an accumulator can be raised by transferring liquid directly from the receiver. Such a variation of an alternative climate control system 20A is shown in FIG. 2. To the extent that components in the system are the same as or similar to those described in FIG. 1, the same reference numbers will be used and unless otherwise addressed, for brevity, will not be discussed again herein. In climate control system 20A, a first bypass line 70 in the form of a liquid bypass originates at a three-way valve 72 disposed in line 74 between receiver 48 and second expansion valve 52. The first bypass line 70 diverts a portion of the working fluid stream exiting receiver 48 into accumulator 44. In this manner, the working fluid exiting the receiver 48 is a near-saturated or saturated condensate working fluid (e.g., liquid phase) leaving the receiver 48 and when it is returned to the accumulator 44 (bypassing both the second expansion valve 52 and the evaporator 40 in the fluid conduit 22), serves to reduce an amount of vapor or gas in the accumulator 44 and thus increases an overall amount of liquid in the accumulator 44. The first bypass line 70 may further comprise a metering valve 76 that is used to regulate a flow rate of the diverted liquid stream of working fluid into the accumulator 44. Such a metering valve 76 may be associated with equipment measuring flow rate, pressure, temperature, and the like of the stream in the first bypass line 70 and an associated control system.

Figure 3:
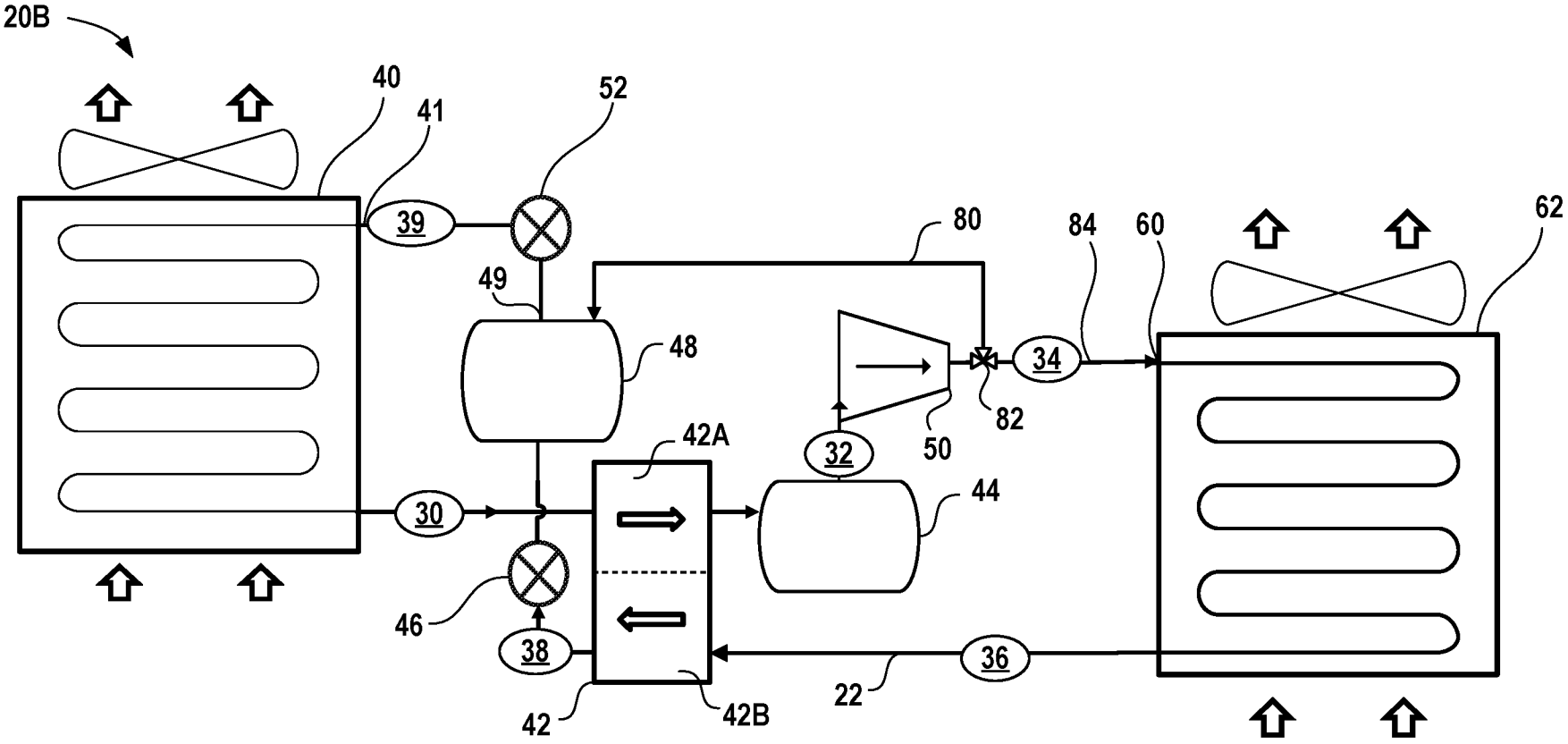
FIG. 3 shows a schematic of yet another example embodiment of a climate control system for circulating a working fluid having blended refrigerants that exhibits high glide prepared in accordance with certain aspects of the present disclosure that includes a liquid-to suction heat exchanger, an accumulator, a receiver and further includes a vapor bypass line.

In yet other variations described herein, by using a condenser and liquid-to-suction heat exchanger bypass for discharge gas, a level of liquid in a receiver can be lowered and allowing subcooling to raise the level in a receiver. Such a variation of an alternative climate control system 20B is shown in FIG. 3. To the extent that components in the system are the same as or similar to those described in FIG. 1 or 2, the same reference numbers will be used and unless otherwise addressed, for brevity, will not be discussed again herein. As will be appreciated by those of skill in the art, any of the features and components described in the context of FIG. 3 may be used individually or in combination in the climate control system described in the context of FIG. 1 or 2. In climate control system 20B, a second bypass line 80 in the form of a vapor bypass originates at a three-way valve 82 disposed in line 84 between compressor 50 and inlet 60 to condenser 62. The second bypass line 80 passes a diverted portion of the working fluid stream exiting compressor 50 into the receiver 48. In this manner, the working fluid at point 34 exiting the compressor 50 is a high-pressure vapor or gas stream and when it is returned to the receiver 48 (bypassing both the condenser 62 and the liquid-to-suction heat exchanger 42 in the fluid conduit 22), serves to increase an amount of vapor or gas in the receiver 48 and thus reduces an overall amount of liquid in the receiver 48.

In other aspects, a cooling capacity of the climate control system may be modulated by a combination of using stepped compression and modifying refrigerant concentration or alternatively, using variable speed compression and refrigerant concentration, or alternatively, cycling off individual compressors in a system having multiple compressors and modifying refrigerant concentration to achieve lower capacity turn down or continuous capacity control.

In yet another aspect, where another fluid is included in the system (such as an oil in the working fluid), that fluid may be preferentially soluble with (in other words having a greater solubility in) a single component of the refrigerant blend (e.g., either with first refrigerant (A) or second refrigerant (B)) in order to store a concentrated amount of a single component (e.g., either high-pressure first refrigerant (A) or low-pressure second refrigerant (B)) in an oil sump (typically disposed within the compressor 50) or another tank in part of the system 20. Thus, above a given pressure and temperature, the oil may reach a solubility limit for one of the first refrigerant or the second refrigerant, such that only one of the refrigerants remains soluble in the oil, while the other is not and no longer circulates in the working fluid.

As will be appreciated, for a climate control system in the form of a heat pump system, portions of the heat pump system may be located indoors or in confined spaces, while the remaining portions of the heat pump system are located outdoors. Such a heat pump system is described in co-owned U.S. Publication No. 2023/0130167 entitled "Climate Control Systems for Use with High Glide Working Fluids and Methods for Operation Thereof," to Welch et al., which is incorporated herein by reference. A first heat exchanger is disposed indoors and may be operated as a condenser in a first operational mode or heating mode or an evaporator in a second operational mode or cooling mode. The first heat exchanger is commonly referred to as an air-handling unit that provides a supply side and a return side for processing air for an indoor environment. The first heat exchanger may include a fan and a coil. Depending on the operational mode, the supply air that is passed over the coil (for example, in a countercurrent direction, although concurrent flow may also occur) may be either heated or cooled.

The heat pump system also includes a second heat exchanger disposed outdoors that likewise includes a fan and a coil. The second heat exchanger is commonly referred to as an outdoor unit and circulates ambient air across the coil and generates exhaust. Depending on the operational mode, the ambient air that is passed over the coil (for example, in a countercurrent direction, although concurrent flow may also occur) may be cooled or heated. The second heat exchanger may be operated as an evaporator in the first operational mode or heating mode or a condenser in the second operational mode or cooling mode. The heat pump system will be described herein in the first operational mode where the first heat exchanger operates a condenser to heat supply air indoors, while the second heat exchanger operates as an evaporator. As will be appreciated by those of skill in the art, the concepts discussed herein are equally applicable to operation in the second operational mode, as well.

In certain aspects, a pair of four-way valves may be used in the fluid conduit between components, so that flow of the working fluid can be reversed so that the system operates in either the first operational mode of the second operation mode. As will be appreciated by those of skill in the art, the heat pump system may instead have one or more reversing valves to direct working fluid flow in a different direction in the system.

The heat pump system may circulate the working fluid with two refrigerants having high glide or a difference in boiling points between the first refrigerant (A) and the second refrigerant (B) of greater than or equal to about 269K at atmospheric pressure, by way of example. In one example, where a first refrigerant (A) may be carbon dioxide ($CO_2$) while a second refrigerant (B) may be R-1233zd. The initial refrigerant blend introduced into the heat pump system 300 may have approximately 93% by wt. $CO_2$ and 7% by wt. of R-1233zd. Like the previously described embodiments, the working fluid may also include oil(s) at certain points in the system. The heat pump system has a fluid flow path or fluid conduit that establishes fluid communication between the various components, so that the working fluid may circulate in a loop as discussed further herein.

In various aspects, control of the climate control systems, including heat pump systems, described in any of the embodiments above may be achieved by a control module. In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

In various aspects, the control module can be used to activate, deactivate, or modulate operation of various components and devices in the climate control system, including compressor(s), fan(s), pump(s), valve(s), and the like. The control module may receive input from various sensors in the climate control system, such as temperature sensors, pressure sensors, flow rate sensors, current and voltage meters, etc. The sensors provide measurements from which a control module can determine necessary modifications to the climate control system.

The control module can include one or more modules and can be implemented as part of a control board, furnace board, thermostat, air handler board, contactor, or other form of control system or diagnostic system. The control module can contain power conditioning circuitry to supply power to various components using 24 Volts (V) alternating current (AC), 120V to 240V AC, 5V direct current (DC) power, etc. The control module can include bidirectional communication which can be wired, wireless, or both whereby system debugging, programming, updating, monitoring, parameter value/state transmission etc. can occur. Climate control systems can more generally be referred to as air conditioning or refrigeration systems.

Thus, a control module may open, close, regulate, or direct working fluid flow (or portions of working fluid flow, such as first refrigerant and/or second refrigerant) into and out of various components and devices in the system via the conduits, including in the evaporator, condenser, expansion valve, gas-liquid separator, heat exchangers, storage vessels, and the like.

In certain aspects, the present disclosure provides methods for operating a climate control system that circulates a working fluid comprising a refrigerant blend having high glide. Such methods may modulate cooling capacity of the climate control systems as described above, by taking advantage of the high glide properties or fractionation behavior of the refrigerant blend selected. The methods may comprise circulating a working fluid in any of the climate control systems described above. For example, the working fluid may be circulated through a fluid conduit that comprises a compressor for pressurizing the working fluid, a condenser disposed downstream of the compressor for condensing at least a portion of the working fluid, a liquid-to suction heat exchanger for exchanging heat between the stream leaving the condenser and a stream leaving the evaporator, at least one expansion valve disposed downstream of the liquid-to suction heat exchanger to reduce a pressure of the working fluid, a receiver to store at least a portion of the working fluid, an evaporator disposed downstream of the receiver for evaporating at least a portion of the working fluid, and an accumulator to store at least a portion of the working fluid disposed downstream of the liquid-to suction heat exchanger and upstream of the compressor. As described previously above, the working fluid comprises a refrigerant blend having high glide that comprises a first refrigerant and a second refrigerant, where a difference in boiling points between the first refrigerant and the second refrigerant is at least greater than or equal to about 25°R (about 14K) at atmospheric pressure.

In one aspect, the present disclosure provides a method of operating a climate control system that circulates a working fluid comprising a refrigerant blend having high glide. The method includes pressurizing a working fluid vapor by passing it through a compressor in a fluid conduit. At least a portion of the working fluid is condensed in a first heat exchanger disposed downstream of the compressor. The working fluid is then cooled by passing through a liquid-to-suction heat exchanger in a first flow direction. The method also includes reducing pressure of the working fluid by passing through a first expansion device disposed downstream of the liquid-to-suction heat exchanger and the first heat exchanger.

The method may thus comprise passing the working fluid stream from the condenser through a first side of liquid-to-suction heat exchanger in a first flow direction and passing the low-pressure multiphase working fluid stream from the evaporator in a second flow direction to transfer heat therebetween. In certain aspects, the method may include modifying the balance of charge in the system by operating with less subcooling at the outlet of the suction to liquid-to-suction heat exchanger.

Then, the working fluid is passed from the first expansion device into a receiver. At least a portion of the working fluid may be stored in the receiver. For example, a liquid portion of the working fluid may be stored in the receiver. The liquid portion of the working fluid in the receiver may have a higher stored quantity of the first refrigerant (A) having a relatively high-pressure or low-critical point. As described in our new learning, a stored quantity of liquid stored in the receiver is consistent with the range of liquid circulated through the system, in certain aspects, the stored amount may be greater than or equal to 0 to 15% by mass.

The method includes further reducing pressure of the working fluid exiting the receiver by passing through a second expansion device disposed downstream of the receiver. At least a portion of the working fluid is evaporated in a second heat exchanger disposed downstream of the second expansion valve. The method further includes heating the working fluid exiting the second heat exchanger by passing through the liquid-to-suction heat exchanger in a second flow direction. The working fluid can be passed into an accumulator upstream of the compressor. At least a portion of the working fluid may be stored in the accumulator. In certain aspects, conditions at the inlet to the accumulator may be a degree of superheat that may range from greater than or equal to about −8.3 K (e.g., −15°R) to less than or equal to about 16.7 K (e.g., 30°R).

The working fluid vapor exits the accumulator and enters the compressor, wherein the working fluid comprises the refrigerant blend having high glide that comprises a first refrigerant and a second refrigerant, wherein a difference in boiling points between the first refrigerant and the second refrigerant is greater than or equal to about 25°R (about 14K) at atmospheric pressure.

In various aspects, a concentration of the second refrigerant (B) having a relatively low-pressure or high-critical point in the accumulator is greater than an amount of the second refrigerant (B) circulating within the climate control system 20, while a concentration of the second refrigerant (B) is the same as the amount circulating within the climate control system 20. The liquid portion of the working fluid in the accumulator may have a higher stored quantity of the second refrigerant (B) having a relatively low-pressure or high-critical point and thus a lower quantity of the first refrigerant (A) having a relatively high-pressure or low-critical point. Further, as noted above, stored liquid in the receiver has a lower concentration of the second refrigerant (B) with a relatively low pressure of high-critical point or a higher concentration of the first refrigerant (A) having a relatively high-pressure or low-critical point. Thus, in certain aspects, refrigerant concentration in the working fluid can be controlled by adjusting or shifting liquid between the receiver and the accumulator.

In certain variations, the methods comprise controlling concentrations of the first refrigerant and the second refrigerant in the refrigerant blend in the climate control system by (i) adjusting a first stored amount of liquid in the receiver; (ii) adjusting a second stored amount of liquid in the accumulator; or (iii) both (i) and (ii). In certain other variations, where the first refrigerant (A) has first critical point that is less than a second critical point of the second refrigerant (B), the method comprises controlling concentrations of the refrigerant blend in the climate control system by one or more of: (i) adjusting a first stored amount of the first refrigerant as a liquid in the receiver; (ii) adjusting a second stored amount of the second refrigerant as a liquid in the accumulator; or (iii) both (i) and (ii). In certain further aspects, the controlling of concentrations of the first refrigerant and the second refrigerant in the refrigerant blend in the climate control system can occur by adjusting a stored amount of liquid in the accumulator.

In one aspect, the high glide refrigerant blend defines a full phase change for condensation and the condensing only partially condenses the working fluid to a liquid phase and permits only a portion of the full phase change to occur. In this manner, after the condensing, a greater portion or percentage of the second refrigerant (B) is liquid, while a greater portion or percentage of the first refrigerant (A) remains as vapor and a lesser portion of the first refrigerant (A) is liquid as it enters the liquid-to suction heat exchanger. In another aspect, the high glide refrigerant blend defines a full phase change for evaporation, but the evaporating only partially evaporates the working fluid to a vapor phase and permits only a portion of the full phase change to occur. In this manner, after the evaporating, a greater portion or amount of the first refrigerant (a) is vapor, while a lesser portion of the second refrigerant (B) is vapor and a greater portion of the second refrigerant (B) remains as liquid as it enters the liquid-to suction heat exchanger.

In certain variations, the condensing only partially condenses the working fluid to a liquid phase and the evaporating only partially evaporates the working fluid to a vapor phase. The evaporating is performed on a fluid stream having a first vapor quality that is higher than a second vapor quality.

In other aspects, the fluid conduit further comprises at least one storage vessel in addition to the accumulator and receiver, so that the method comprises further comprising storing a portion of the first refrigerant and/or second refrigerant in the at least one storage vessel to modulate cooling capacity of the system.

The methods may further comprise circulating air through the evaporator and condenser in a heat transfer relationship with the fluid conduit to transfer heat to the working fluid (e.g., prior to entering the evaporator). In certain aspects, a first temperature range of the refrigerant blend is operated to be greater than or equal to about 50% to less than or equal to about 200%, optionally greater than or equal to about 66% to less than or equal to about 150% of a second temperature range of the air.

In other aspects, a cooling capacity of the climate control system may be modulated by employing compressors that achieve stepped compression, for example, a combination of using stepped compression and modifying refrigerant concentration. In another variation, variable speed compression and refrigerant concentration can be used to modulate system capacity. In yet another variation, a system that has multiple compressors in the fluid conduit may be individually cycled off and modifying refrigerant concentration to achieve lower capacity turn down or continuous capacity control.

In yet another aspect, where another fluid is included in the system (such as an oil in the working fluid), that fluid may be preferentially soluble with a single component of the refrigerant blend (e.g., either with first refrigerant or second refrigerant) in order to store a concentrated amount of a single component (e.g., either high-pressure first refrigerant or low-pressure second refrigerant) in an oil storage vessel or select regions in part of the system In certain other aspects, a refrigerant blend may include any of the refrigerants discussed above, such as a first refrigerant that is an A1 refrigerant such as $CO_2$ mixed with a second refrigerant that is a flammable refrigerant (such as an ASHRAE 34 class A3), like dimethyl ether. In this variation, the system maintains a ratio of the relatively inert first refrigerant (e.g., A1 refrigerant) to limit an amount of the second flammable refrigerant on the indoor side of the system to a safe level. Further, the climate control system could have an indoor portion and an outdoor portion that may be isolated from one another, such as is described in co-owned U.S. Patent Publication No. 2022/0082304 entitled "Refrigerant Isolation Using a Reversing Valve," to Welch et al., the relevant portions of which are incorporated by reference. In other aspects, the present disclosure may contemplate a method of calculating an amount of the second flammable refrigerant component of a binary mixture of the first and second refrigerant on the indoors, for example, as described in co-owned U.S. Pat. No. 11,131,471 entitled "Refrigerant Leak Detection," to Butler et al., the relevant portions of which are incorporated by reference, where charge can be calculated by using the proportional relationship between enthalpy and specific volume of a refrigerants, but employs more than the four described measurements.

Further, the cycle could allow some limited variation in refrigerant concentration by allowing storage in a section of the system or could maintain the same concentrations through all conditions to maintain the same safe level of flammable refrigerant from the baseline operating condition.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A climate control system that circulates a working fluid comprising a refrigerant blend having high glide, the climate control system comprising:

the working fluid comprising a first refrigerant and a second refrigerant, wherein a difference in boiling points between the first refrigerant and the second refrigerant is greater than or equal to about 25°R at atmospheric pressure, wherein the climate control system is configured to maintain the working fluid in a sub-critical state during operation;

an accumulator;

a compressor that receives a vapor stream of the working fluid from the accumulator and generates a pressurized vapor stream;

a first heat exchanger disposed downstream of the compressor that receives and cools the pressurized vapor stream to generate a multiphase or liquid condensate stream of the working fluid;

a liquid-to-suction heat exchanger disposed downstream of the first heat exchanger and upstream of the accumulator;

a receiver disposed downstream of the liquid-to-suction heat exchanger;

a first expansion device disposed between the liquid-to-suction heat exchanger and the receiver that processes the multiphase or liquid condensate stream from the liquid-to-suction heat exchanger;

a second expansion device disposed between the receiver and a second heat exchanger that processes the multiphase or liquid condensate stream to reduce pressure prior to the second heat exchanger to form a reduced-pressure multiphase stream of the working fluid;

the second heat exchanger receives the reduced-pressure multiphase stream from the second expansion device and at least partially vaporizes the reduced-pressure multiphase stream to form a vaporized stream of the working fluid that is then directed to the liquid-to-suction heat exchanger and to the accumulator; and a fluid conduit for circulating the working fluid and establishing fluid communication between the accumulator, the compressor, the first heat exchanger, liquid-to-suction heat exchanger, the first expansion device, the receiver, the second expansion device, and the second heat exchanger through which the working fluid circulates.

2. The climate control system of claim 1, wherein the liquid-to-suction heat exchanger receives the multiphase or liquid condensate stream from the first heat exchanger in a first flow direction and the vaporized stream from the second heat exchanger in a second flow direction to transfer heat therebetween.

3. The climate control system of claim 1 that is free of any pumps.

4. The climate control system of claim 1, further comprising a liquid bypass line that diverts a portion of the working fluid exiting the receiver into the accumulator.

5. The climate control system of claim 4, wherein the liquid bypass line further comprises a liquid metering valve.

6. The climate control system of claim 1, further comprising a vapor bypass line that diverts a portion of the working fluid exiting the compressor into the receiver.

7. The climate control system of claim 1, wherein the first refrigerant and the second refrigerant are selected from the group consisting of: carbon dioxide (R-744), chlorodifluoromethane (R-22), 1,1,1,2-tetrafluoroethane (R-134A), R-410A (a near-azeotropic mixture of difluoromethane (R-32) and pentafluoroethane (R-125), 1,1-difluoroethane (R-152A), dimethyl ether (R-E170), propane (R-290), 2,3,3,3,-tetrafluoroprop-1-ene (R-1234yf), cis- and trans-1,3,3,3,-tetrafluoropropene (HFO-1234ye), cis- and trans-1,3,3,3,-tetrafluoroprop-1-ene (R-1234ze), 3,3,3,-trifluoropropene (HFO-1234zf), trifluoro, monochloropropenes (HFO-1233), trans-1-chloro-3,3,3-trifluoropropene (HFO-1233zd(E)), cis-1-chloro-3,3,3-trifluoropropene (HFO-1233zd(Z)), 2-chloro-3,3,3-trifluoropropene (HFO-1233xf), trans-1,1,1,4,4,4-hexafluoro-2-butene (HFO-1336mzz(Z)), cis-1,1,1,4,4,4-hexafluoro-2-butene (HFO-1336mzz(E)), pentafluoropropenes (HFO-1225), 1,1,3,3,3-pentafluoropropene (HFO-1225zc), 1,2,3,3,3-pentafluoropropene (HFO-1225yez), hexafluorobutenes (HFO-1336), cis-1,1,1,4,4,4-hexafluoro-2-butene (HFO-1336mzz(Z)), trans-1,1,1,4,4,4-hexafluoro-2-butene (R-1336mzz(E)), trans-1,2-difluoroethene (R-1132(E)), and any isomers or combinations thereof.

8. The climate control system of claim 1, wherein the first refrigerant comprises carbon dioxide (R-744), and the second refrigerant comprises a hydrofluorolefin.

9. A method for operating a climate control system that circulates a working fluid comprising a refrigerant blend having high glide, the method comprising:

pressurizing a vapor stream of the working fluid by passing it through a compressor in a fluid conduit;

condensing at least a portion of the working fluid in a first heat exchanger disposed downstream of the compressor;

cooling the working fluid by passing through a liquid-to-suction heat exchanger in a first flow direction;

reducing pressure of the working fluid by passing through a first expansion device disposed downstream of the liquid-to-suction heat exchanger and the first heat exchanger;

passing the working fluid from the first expansion device into a receiver;

further reducing pressure of the working fluid exiting the receiver by passing through a second expansion device disposed downstream of the receiver;

evaporating at least a portion of the working fluid in a second heat exchanger disposed downstream of the second expansion device;

heating the working fluid exiting the second heat exchanger by passing through the liquid-to-suction heat exchanger in a second flow direction; and passing the working fluid into an accumulator upstream of the compressor, so that the vapor stream of the working fluid exits the accumulator and enters the compressor, wherein the working fluid comprises the refrigerant blend having high glide that comprises a first refrigerant and a second refrigerant, wherein a difference in boiling points between the first refrigerant and the second refrigerant is greater than or equal to about 25°R at atmospheric pressure and the working fluid is maintained at a sub-critical state during operation of the climate control system.

10. The method of claim 9, comprises controlling concentrations of the first refrigerant and the second refrigerant in the refrigerant blend in the climate control system by (i) adjusting a first stored amount of liquid in the receiver; (ii) adjusting a second stored amount of liquid in the accumulator; or (iii) both (i) and (ii).

11. The method of claim 9, wherein the first refrigerant has a first critical point that is less than a second critical point of the second refrigerant and the method comprises controlling concentrations of the refrigerant blend in the climate control system by one or more of: (i) adjusting a first stored amount of the first refrigerant as a liquid in the receiver; (ii) adjusting a second stored amount of the second refrigerant as a liquid in the accumulator; or (iii) both (i) and (ii).

12. The method of claim 9, comprises controlling concentrations of the first refrigerant and the second refrigerant in the refrigerant blend in the climate control system by adjusting a stored amount of liquid in the accumulator.

13. The method of claim 9, wherein the heating the working fluid exiting the second heat exchanger by passing through the liquid-to-suction heat exchanger in the second flow direction adjusts the working fluid to have a superheated level that is either positive or negative, wherein the superheated level adjusts a stored amount of liquid in the accumulator.

14. The method of claim 9, further comprising diverting a portion of the working fluid exiting the receiver into a liquid bypass line that directs the portion of the working fluid into the accumulator.

15. The method of claim 14, wherein the liquid bypass line further comprises a liquid metering valve that regulates flow of the working fluid in the liquid bypass line.

16. The method of claim 9, further comprising diverting a portion of the working fluid exiting the compressor into a vapor bypass line that directs the portion of the working fluid into the receiver.

17. The method of claim 9, wherein the refrigerant blend having high glide defines a full phase change for condensation and the condensing only partially condenses the working fluid to a liquid phase and permits only a portion of the full phase change to occur, so that after the condensing, the second refrigerant is predominantly liquid, while a portion of the first refrigerant is liquid and a portion of the first refrigerant remains as vapor as it enters the liquid-to-suction heat exchanger.

18. The method of claim 9, wherein the refrigerant blend having high glide defines a defines a full phase change for evaporation and the evaporating only partially evaporates the working fluid to a vapor phase and permits only a portion of the full phase change to occur, so that after the evaporating, the first refrigerant is vapor, while a portion of the second refrigerant is vapor and a portion of the second refrigerant remains as liquid as it enters the liquid-to-suction heat exchanger.

19. The method of claim 9, wherein the condensing only partially condenses the working fluid to a liquid phase and the evaporating only partially evaporates the working fluid to a vapor phase.

20. The method of claim 9, wherein the first refrigerant and the second refrigerant are selected from the group consisting of: carbon dioxide (R-744), chlorodifluoromethane (R-22), 1,1,1,2-tetrafluoroethane (R-134A), R-410A (a near-azeotropic mixture of difluoromethane (R-32) and pentafluoroethane (R-125), 1,1-difluoroethane (R-152A), dimethyl ether (R-E170), propane (R-290), 2,3,3,3,-tetrafluoroprop-1-ene (R-1234yf), cis- and trans-1,3,3,3,-tetrafluoropropene (HFO-1234ye), cis- and trans-1,3,3,3,-tetrafluoroprop-1-ene (R-1234ze), 3,3,3,-trifluoropropene (HFO-1234zf), trifluoro, monochloropropenes (HFO-1233), trans-1-chloro-3,3,3-trifluoropropene (HFO-1233zd(E)), cis-1-chloro-3,3,3-trifluoropropene (HFO-1233zd(Z)), 2-chloro-3,3,3-trifluoropropene (HFO-1233xf), trans-1,1,1,4,4,4-hexafluoro-2-butene (HFO-1336mzz(Z)), cis-1,1,1,4,4,4-hexafluoro-2-butene (HFO-1336mzz(E)), pentafluoropropenes (HFO-1225), 1,1,3,3,3-pentafluoropropene (HFO-1225zc), 1,2,3,3,3-pentafluoropropene (HFO-1225yez), hexafluorobutenes (HFO-1336), cis-1,1,1,4,4,4-hexafluoro-2-butene (HFO-1336mzz(Z)), trans-1,1,1,4,4,4-hexafluoro- 2-butene (R-1336mzz(E)), trans-1,2-difluoroethene (R-1132 (E)), and any isomers or combinations thereof.

* * * * *